US005337572A

United States Patent [19]

Longsworth

[11] Patent Number: 5,337,572

[45] Date of Patent: Aug. 16, 1994

[54] CRYOGENIC REFRIGERATOR WITH SINGLE STAGE COMPRESSOR

[75] Inventor: Ralph C. Longsworth, Allentown, Pa.

[73] Assignee: APD Cryogenics, Inc., Allentown, Pa.

[21] Appl. No.: 57,708

[22] Filed: May 4, 1993

[51] Int. Cl.[5] ..... F25B 9/02

[52] U.S. Cl. ..... 62/51.2; 62/114

[58] Field of Search ..... 62/51.2, 114

[56] References Cited

U.S. PATENT DOCUMENTS

| | | | |
|---|---|---|---|
| 3,204,422 | 9/1965 | Buller et al. | 62/51.2 X |
| 3,413,819 | 12/1968 | Hansen | 62/51.2 X |
| 3,698,202 | 10/1972 | Missimer | 62/114 |
| 3,768,273 | 10/1973 | Missimer | 62/84 |
| 4,718,251 | 1/1988 | Thorton | 62/51.2 X |

FOREIGN PATENT DOCUMENTS

| | | |
|---|---|---|
| 627154 | 8/1978 | U.S.S.R. . |
| 1054400 | 2/1981 | U.S.S.R. . |
| 918298 | 4/1982 | U.S.S.R. . |
| 1089099 | 4/1984 | U.S.S.R. . |
| 1336892 | 11/1992 | United Kingdom . |

OTHER PUBLICATIONS

Y. L. Landa, "The Self-Regulating Effect Used in Joule-Thomson Microcryogenic Systems" 14th ICEC, Jun. 1992.

Kuo, "Linear Compressor for JP Cryocoolers" 7th International Cryocooler Conference, Nov. 1992.

*Primary Examiner*—William E. Tapolcai

*Attorney, Agent, or Firm*—Helfgott & Karas

[57] ABSTRACT

A closed cycle refrigerating system for cryogenic temperatures using a single stage compressor with a refrigerant comprising a gas mixture. The refrigerating system includes a heat exchanger having a throttling orifice which is arranged to provide refrigeration, and a single stage oil lubricated compressor for compressing the refrigerant. The compressor is typically of the rolling piston type. The refrigerant is a mixture of at least one cryogenic gas having a normal boiling point below 120 degrees K and at least two other gases having normal boiling point temperatures below 300 degrees different from each other and from said one gas. There is also included means for cooling the compressed refrigerant and for circulating the cooled refrigerant to the heat exchanger and its throttling orifice and then back to the compressor. The system does not require any cascaded heat exchangers or intermediate phase separators.

16 Claims, 4 Drawing Sheets

CRYOGENIC REFRIGERATOR WITH SINGLE STAGE COMPRESSOR

BACKGROUND OF THE INVENTION

In closed cycle refrigerating systems intended to provide temperatures in the usual household or commercial range, the refrigerant gas is compressed and then condensed, the condensed fluid is throttled and evaporated to produce the refrigerating effect, and the evaporated gas is returned to the compressor to complete the cycle. The refrigerants are typically Freon-type pure gases, and a simple single stage reciprocating or rolling piston compressor is sufficient to achieve the modest pressures and efficiencies required.

However, where the refrigerating system is intended to provide very low temperatures in the cryogenic range, such as between 65 degrees and 150 degrees Kelvin, the refrigerants comprise cryogenic gases, usually having boiling temperatures below 130 degrees K, such as Nitrogen, which has a normal boiling temperature of 77 degrees K, or Argon, which has a normal boiling temperature of 87 degrees K, or Methane, which has a normal boiling temperature of 112 degrees K. These cryogenic gases have typically required the use of very high pressure gas systems involving specially designed multistage compressors or high pressure oil-less compressors. Such systems are expensive to manufacture and operate and require frequent maintenance.

Various expedients have been used in closed cycle refrigerating systems operating in the intermediate range between the household refrigerating temperatures and about 150 degrees K to produce refrigeration at pressures low enough that a single stage oil-lubricated compressor designed for higher temperatures can still be used. For example, mixtures of primarily Freon-based refrigerants have generally been used rather than pure Freon refrigerants to permit lower pressures. Such mixed-gas refrigerants have also been used with cascaded heat exchangers or with successive stages of vapor-liquid separation in order to permit use of a single compressor for the system. Such expedients are well described, for example, in U.S. Pat. 3,768,273, issued Oct. 30, 1973 to Missimer.

However, for temperatures in the range of 65 degrees K to 150 degrees K, where very low boiling point cryogenic gases such as Nitrogen, Argon or Methane are involved, the required ratios between the low input pressures and the high discharge pressures for refrigerators operating in a normal ambient environment are so great that only multistage compressors have heretofore been used. The number of additional heat exchangers or intermediate phase separators becomes so great as to be deemed impractical.

SUMMARY OF THE INVENTION

Accordingly, a principal object of the invention is to provide a closed cycle refrigerating system for operation in a normal ambient environment to provide cooling temperatures within the cryogenic temperature range below 150 degrees K which utilizes a single stage oil-lubricated compressor and does not require cascaded heat exchangers or intermediate phase separators. The advantages in lower manufacturing, operating and maintenance costs of such a single compressor stage cryogenic temperature refrigerating system, are self-evident.

In general, in accord with the invention, I have found that it is unexpectedly possible to achieve many watts of refrigerating capacity at temperatures below 150 degrees K in a single closed circuit refrigerating system operating in a normal ambient environment without additional phase separators by using a single stage oil-lubricated compressor having a very high volumetric efficiency at a relatively high pressure ratio in combination with a refrigerant comprising a mixture of gases including at least one very low boiling point cryogenic gas, such as Nitrogen, Argon or Methane. Preferably, the compressor should have a volumetric efficiency above 50% when operating under a pressure ratio of at least 5 to 1. I have found that the typical rolling piston compressor, such as designed for use with Freon-type refrigerants, can easily meet these conditions.

More specifically, the closed cycle refrigerating system of the invention may comprise an oil-lubricated single stage rolling piston compressor, an oil separator for removing entrained oil from the compressed gas and for returning the separated oil to the compressor low pressure line, an after-cooler for removing heat of compression from the compressed gas, and a cryogenic heat exchanger, such as a Joule-Thomson cryostat, connected between the after-cooler and the compressor. Within the heat exchanger, all of the high pressure fluid stream received from the after-cooler flows to the cold end, where it drops in pressure as it flows through a JT restrictor, absorbs heat from the load being cooled and then returns to the warm end of the compressor through the low pressure line. The heat exchanger is preferably also vacuum insulated to minimize heat losses.

The system is charged with a mixture of a few gases and oil such that when the unit is running the return pressure is in the range of 0.05 MPa to 0.5 MPa, and is compressed by the rolling piston compressor to produce discharge pressures in the range of 1.5 to 3.0 MPa, in order to produce a pressure ratio of at least 5 to 1.

The mixture of gases to be used as the refrigerant should comprise at least one very low boiling point gas, such as Nitrogen and/or Argon and/or Methane, having boiling points less than 130 degrees K, and at least two other gases, such as Ethylene and Propane, having different, preferably higher, boiling points below 300 degrees K, and different isothermal integral throttling effects. Other suitable gases which may be included are Ethane, Isopentane, and Isobutane. Such mixture of gases has several advantages over pure Nitrogen gas alone, including principally the fact that greater cooling effect can be achieved at lower pressures. The number and percentages of the gases to be used are well known to those skilled in the art and are also generally set forth in British Patent 1,336, 892, published November 14, 1973 to Alfeev, Brodyansky, Yagodin, Nikolsfy and Ivantsov.

BRIEF DESCRIPTION OF THE DRAWINGS

The novel features believed characteristic of the invention are set forth in the appended claims. The invention itself, together with any further objects and advantages thereof, will be best understood by reference to the following detailed description, taken in conjunction with the accompanying drawings, in which:

DETAILED DESCRIPTION OF THE INVENTION

Figure 1:
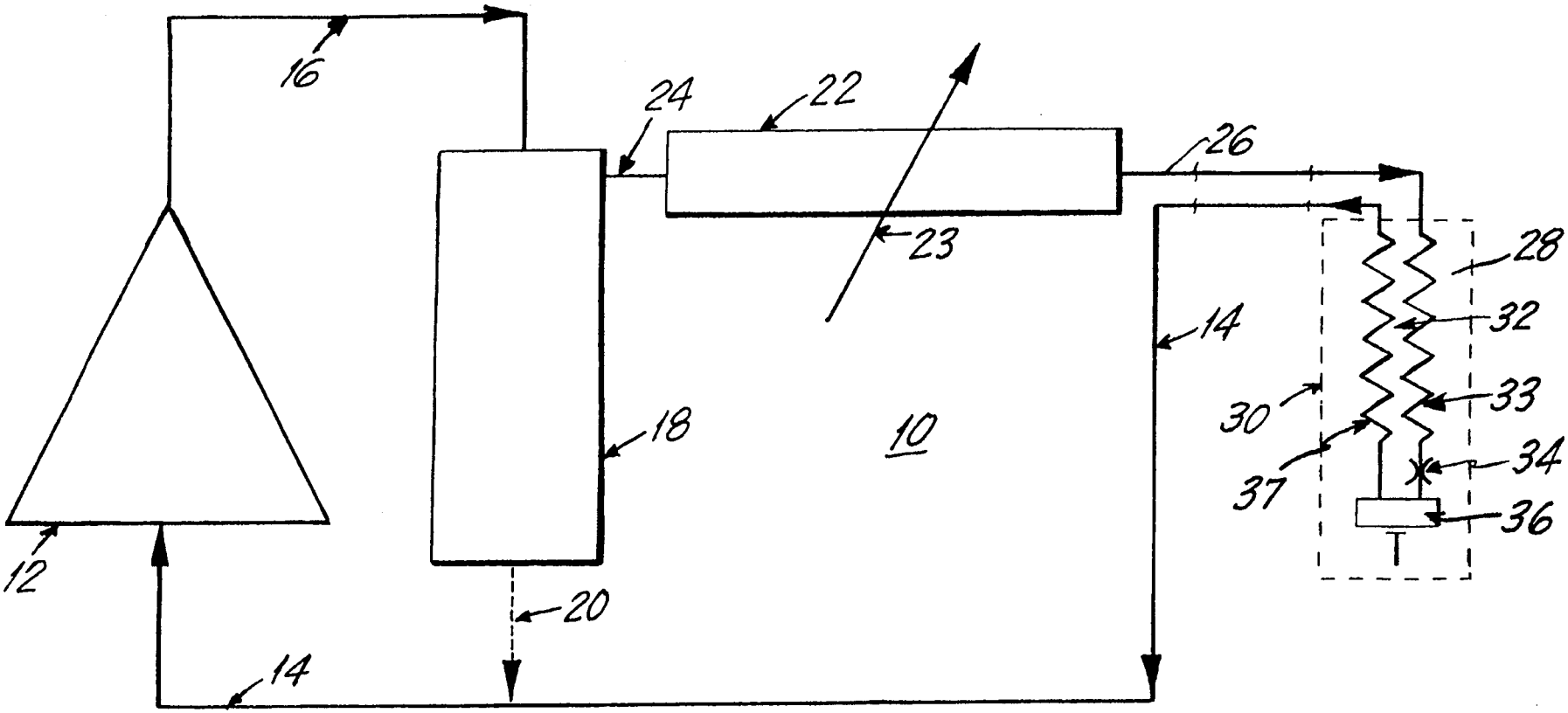
FIG. 1 is a schematic diagram of a closed cycle refrigerating system embodying the invention.

Referring to FIG. 1, a refrigerating system 10 embodying the invention is schematically shown in block diagram as a rolling piston compressor 12, represented by a triangular block, which cyclically receives a refrigerant of mixed gases and entrained oil from a low pressure conduit 14 and discharges compressed gas and entrained oil into a high pressure conduit 16. An oil separator 18, represented by a rectangular block, which may be a simple gas-liquid filter, is connected to receive the compressed gas mixture and entrained oil from conduit 16 and functions to separate the oil from the gas. The oil is delivered back to compressor 12 through a capillary tube 20 and the low pressure line 14. The filtered compressed gas is passed to an after-cooler 22, also represented by a rectangular block, through conduit 24. After-cooler 24 may be air or water cooled, as schematically indicated by the transverse arrow 23, and functions to remove the heat of compression and perhaps to condense a high temperature component, such as Isopentane or Isobutane, in the gas mixture. If, perchance, none of the gases in the mixture are condensed by the after-cooler, oil separator 18 may alternatively be connected to filter the discharge of the after-cooler 22 rather than the direct discharge of the compressor 12.

The cooled fluid emanating from after-cooler 22 may be directly passed through high pressure line 26 to a heat exchanger schematically shown as a Joule-Thomson cryostat 28, preferably encased in vacuum insulation, as indicated by dashed line 30. There is no need for any intermediate phase separators. The JT cryostat 28 comprises a counterflow heat exchanger 32 in which all of the input fluid stream flows through input high pressure coil 33 to the cold end where it drops in pressure as it flows through a JT restrictor 34. The fluid stream then flows contiguous with and absorbs heat from a load 36 being cooled and returns to the warm end of compressor 12 through the low pressure output coil 37 of cryostat 28 and the low pressure return line 14.

In accord with this embodiment of the invention, compressor 12 is a single stage rolling piston compressor capable of achieving substantially higher discharge pressures and volumetric efficiencies vs. pressure ratios than the more conventional reciprocating piston compressors. Compressor 12 is charged with oil and a combination of gases including at least Nitrogen, Argon or Methane, and other gases having differing higher boiling points and isothermal integral throttling effects, as previously explained. The volume of oil should be the amount specified by the compressor manufacturer plus an allowance for the oil that is in the oil separator. The charge pressure is a function of the system volumes. In the embodiment of FIG. 1, most of the system volume is at high pressure so that the charge pressure will be a little less than the high pressure line.

Figure 2:
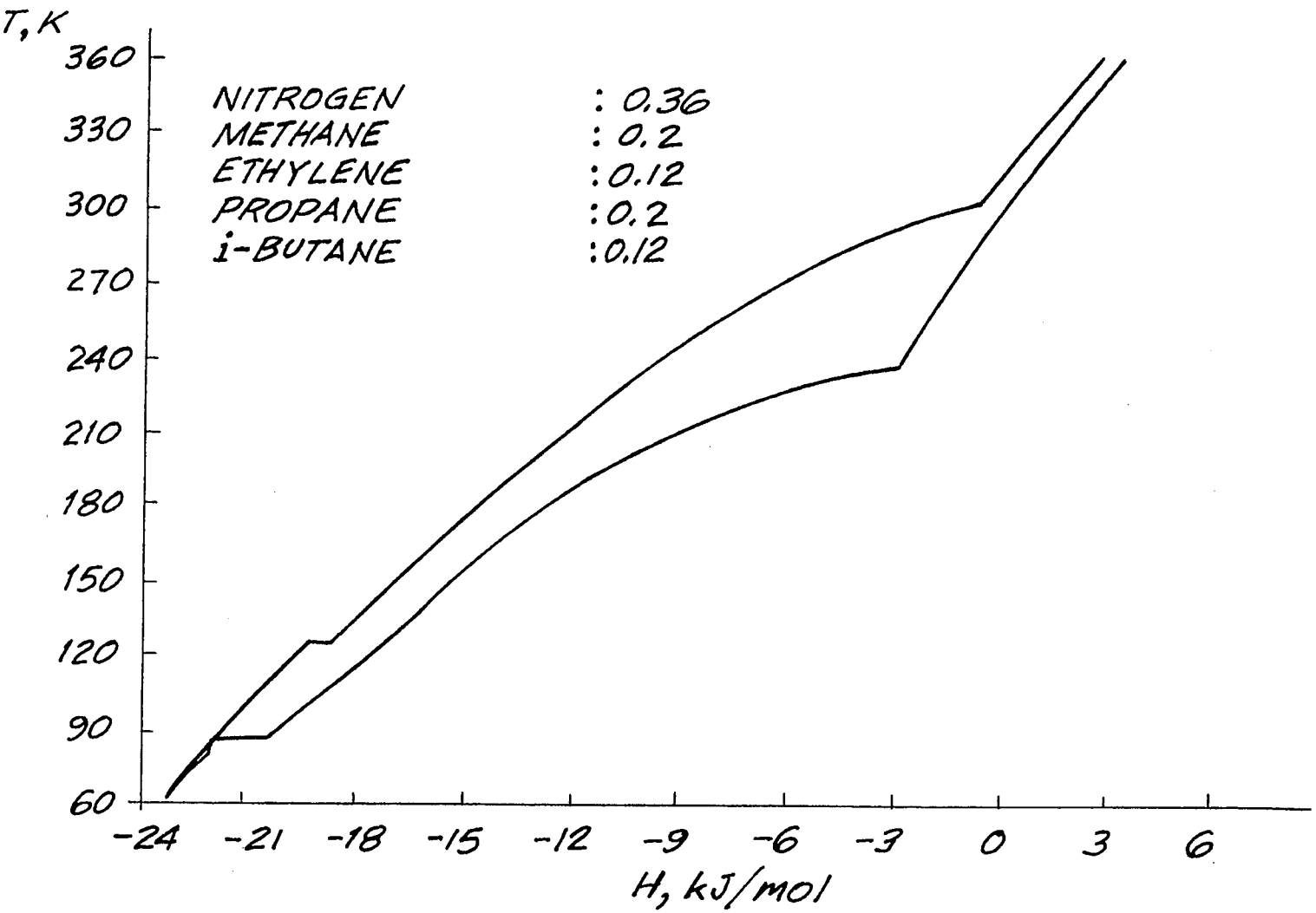
FIG. 2 is a temperature vs. enthalpy diagram for a typical gas mixture refrigerant used in the invention.

One suitable combination of gases has been found to be a mixture of 0.36 Nitrogen, 0.20 Methane, 0.12 Ethylene, 0.20 Propane, and 0.12 Isobutane. Referring to FIG. 2, the temperature-enthalpy diagram for this mixture of gases is shown. As can be seen from this diagram, such mixture of gases is capable of achieving substantially lower temperatures at comparable pressure cycles than pure Nitrogen, Argon or Methane alone.

In general, the combination of gases should include Nitrogen, Argon and/or Methane, 20% to 45% individually or 20% to 60% in any combination, with the remainder made up of at least two other gases selected from Ethane, Ethylene, Propane, Isopentane and Isobutane. The objective is to provide a mixture which achieves desired low temperatures below 150 degrees K with a high pressure no greater than 3.0 MPa and a pressure ratio of less than 18 to 1 but preferably at least 5 to 1.

Figure 3A:
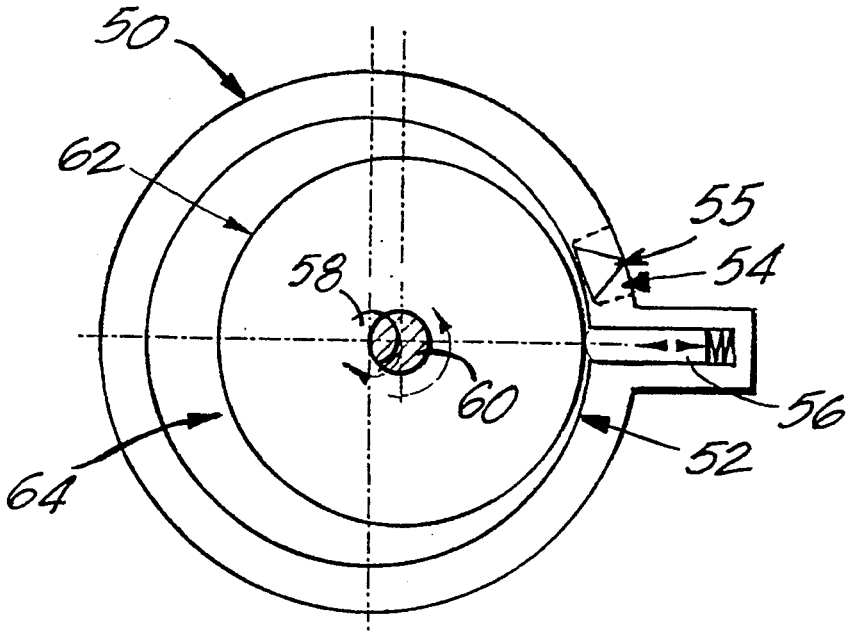
FIGS. 3*a* and 3*b* are corresponding sectional views of a rolling piston compressor operating in gas inlet and gas discharge positions respectively.
Figure 3B:
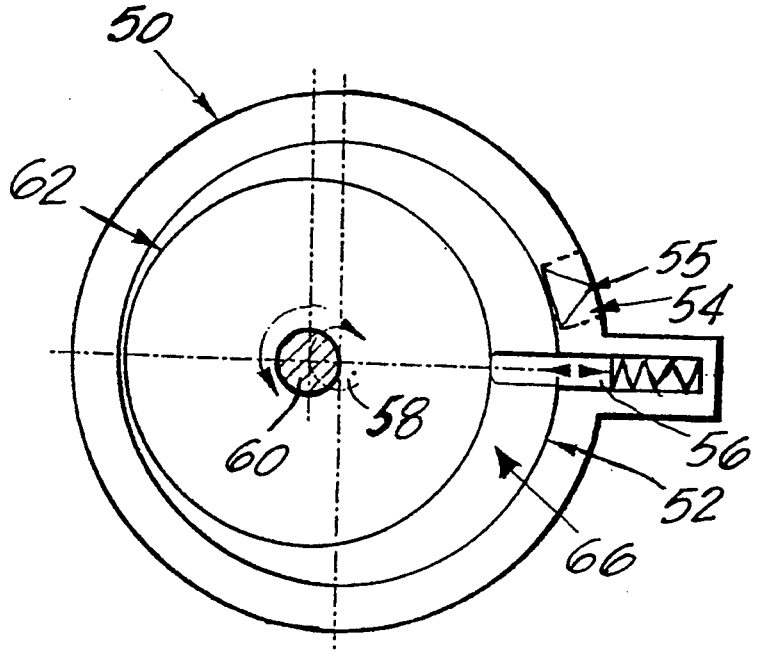

The unusually high volumetric efficiency of the rolling piston compressor can be understood by referring to FIGS. 3*a* and 3*b* which are schematic cross-sections of the compression chamber of a rolling piston compressor. A stationary cylindrical housing 50 has an inlet port 52 with no valve and has a discharge port 54 with a valve 55, these ports 52 and 54 being located on opposite sides of a sliding vane 56. A motor (not shown) has a drive shaft 58 that is centered with respect to the stationary housing, and drive shaft 58 has an eccentric extension shaft 60 on which a cylindrical piston 62 is fixed. This cylindrical piston 62 rolls along the inside wall of the cylindrical housing 50 as the motor rotates. The two flat end plates (not shown) of the cylindrical rolling piston are in close fitting and sliding relation to the flat end walls of the cylindrical housing as the piston rotates. Gas sealing is accomplished by an oil film between all rolling and sliding surfaces. This construction of a rolling piston compressor is typical and conventional.

In FIG. 3*a*, the rolling piston 62 has just finished discharging gas at high pressure through outlet valve 54 and is about to seal the intake port 52 and to start compressing low pressure gas that is trapped in the crescent gap 64 between piston 62 and the inner cylindrical wall of housing 50. In FIG. 3*b*, the rolling piston 62 is in mid-stroke position where the original gas volume is now half its original volume, and half of the next batch of gas to be compressed has filled the opposing crescent gap 66 which is divided by the sliding vane 56.

There are several reasons why it is believed that such rolling piston compressors have proven to be successful in accord with the invention as a single stage compressor in such mixed gas closed cycle cryogenic refrigerating systems. One reason is that such rolling piston compressors can tolerate larger amounts of oil entrained with the gas because the high pressure gas is "squeezed out" of the wedge-shaped crescents, as described above, rather than being trapped above a reciprocating piston flat end plate and causing "hammering" with excess oil. Another reason is that the gas being compressed is in contact with more surface area and more oil than with reciprocating pistons, and the gas is therefore cooled to a greater degree and more efficiently during compression and discharge. Still further reasons are the lack of an input valve and the small clearance volume around the single discharge valve, both of which function to improve the volumetric efficiency.

All of these constructional and operating features of the rolling piston compressor contribute to its unusually high volumetric efficiency vs. pressure ratio characteristics. Volumetric efficiency is defined as the amount of compressed gas that is discharged each cycle divided by the amount of gas that fills the swept volume of the compressor at the return pressure. Not all the gas is discharged because of the clearance volume around the discharge valve and the leakage past the piston itself. Since the leakage is typically very small relative to the gas left in the clearance space, the volumetric efficiency is primarily an inverse function of the pressure ratio. At high pressure ratios it can be influenced significantly by the amount of oil that is injected since the oil helps displace gas from the clearance volume. Rolling piston compressors can tolerate high percentages of oil, for example, up to 0.3%, and can achieve unusually high volumetric efficiency, for example, around 75% at pressure ratios around 5 to 1. At pressure ratios up to 18 to 1, the rolling piston compressor can easily achieve volumetric efficiencies well above 50% for the gas mixtures contemplated to be used.

Figure 4:
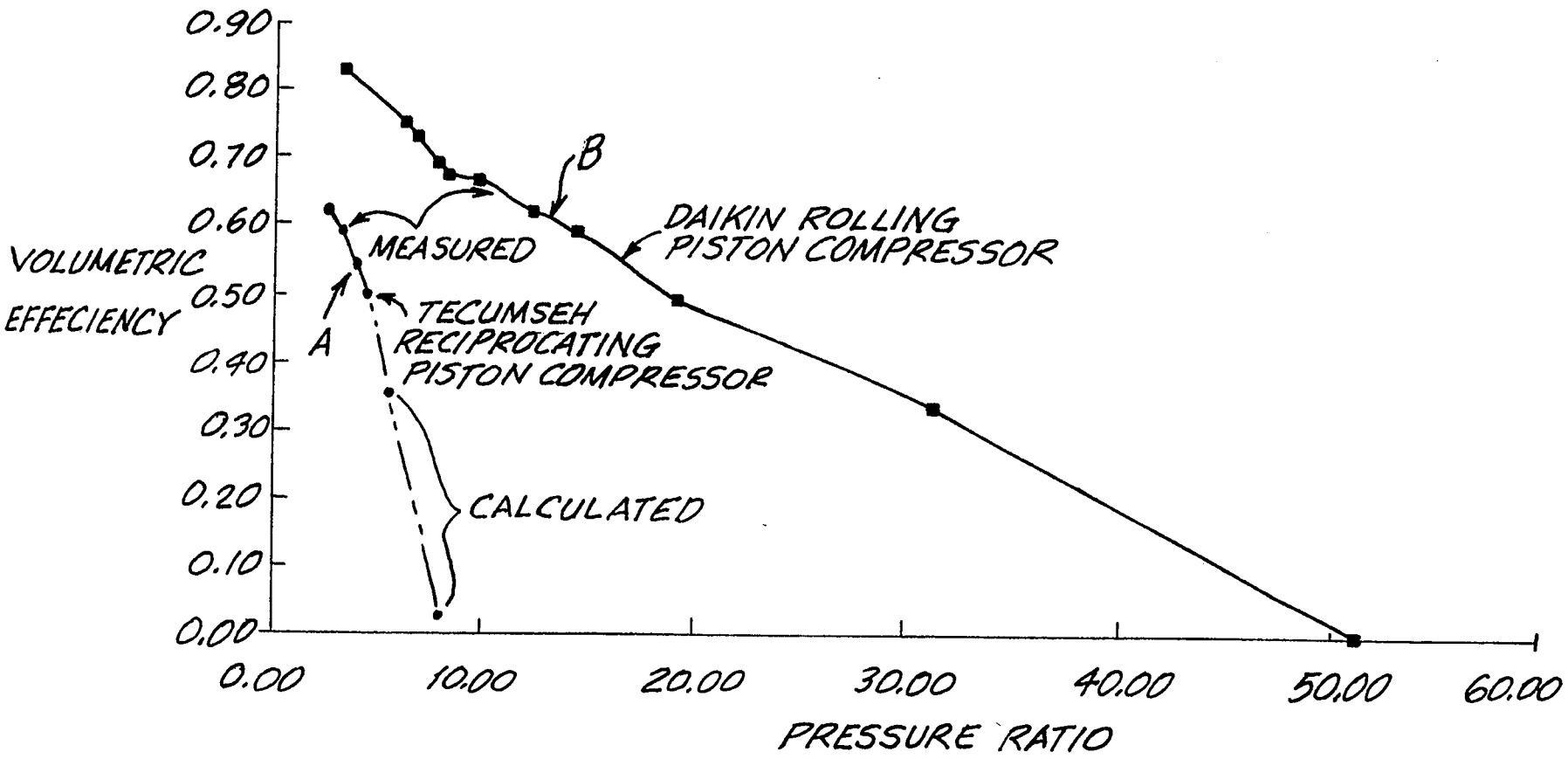
FIG. 4 is a set of two curves comparing the volumetric efficiency vs. pressure ratio of a reciprocating piston compressor and a rolling piston compressor.

Referring now to FIG. 4, the dramatic difference in the volumetric efficiency vs. pressure ratio of the rolling piston compressor than the reciprocating piston compressor is illustrated. Curve A represents data obtained, or calculated, with helium gas in a Tecumseh reciprocating piston compressor. Curve B represents data likewise obtained with helium in a Daikin rolling piston compressor. Both compressors were designed to compress Freon R-22. The rolling piston compressor had a volumetric efficiency of about 50% at a pressure ratio of 18 to 1; - a value that the reciprocating piston compressor could only reach at a pressure ratio of about 4 to 1. The rolling piston compressor achieved a volumetric efficiency of about 78% at this lower 4 to 1 pressure ratio.

In operation of a closed cycle JT cryostat refrigerating system embodying the invention, as described in connection with FIG. 1, the single stage rolling piston compressor was charged with the gas mixture 0.36 Nitrogen, 0.2 Methane, 0.12 Ethylene, 0.2 Propane, and 0.12 Isobutane, as previously set forth, together with 1.2 Liters of oil. The compressor was operated under power inputs in the range of 1 to 1.5 Kilowatts with low pressures in the range of 0.05–0.5 MPa and high pressures in the range of 1.5–2.5 MPa. Typical values of refrigerating capacity and temperatures that were attained in the JT cryostat under an input compressor power of 1.34 Kilowatts included, (1) a measured cooling capacity of 50 watts at a temperature of 109 degrees K with a high pressure of 2.48 MPa and a low pressure of 0.38 MPa, (a pressure ratio of about 6.5 to 1); and (2) a measured cooling capacity of 20 watts at a temperature of 99 degrees K with a high pressure of 2.38 MPa and a low pressure of 0.34 MPa.(a pressure ratio of about 7 to 1). Although specific percentages of gases have been set forth in the mixture of gases described above to obtain these results, it will be understood by those skilled in the art that these percentages may be varied to a considerable degree, by as much as plus or minus 30%, and still achieve substantially improved cooling capacities at the temperatures involved.

It will, of course, be understood that other higher temperatures below 150 degrees K and above this 109 degrees K temperature can easily be achieved with even greater refrigerating capacity by using the above or other mixtures and percentages of gases. At the other temperature extreme, temperatures as low as 65 degrees K can be achieved with practically significant cooling capacity by using different mixtures of gases with lower boiling points, as is well understood in the art. However, the optimum utility temperature range for the invention is between 90 degrees K and 125 degrees K. The compressor may conveniently operate between a low pressure in the neighborhood of 0.35 MPa and a high pressure in the neighborhood of 2.45 MPa.

Another mixture that is useful is a Methane based mixture of 0.35 Methane, 0.25 Ethane, 0.25 Propane and 0.15 Isobutane. This will get below 130 degrees K with a low pressure of about 1 MPa and a discharge pressure of about 15 MPa.

While I have described a particular embodiment of the invention, many modifications can be made, and I intend by the appended claims to cover all such modifications which generally fall within a broad interpretation of the scope of the language employed.

I claim:

1. A closed cycle refrigerating system of the type having a heat exchanger with a throttling orifice for providing cooling temperatures below 150 degrees K and above 65 degrees K in a normal ambient environment comprising, a refrigerant comprising a mixture of at least one cryogenic gas having a normal boiling temperature below 130 degrees K and at least two other gases having normal boiling temperatures below 300 degrees K different from each other and from said one gas, a single stage oil-lubricated compressor operative in said normal ambient environment for compressing said refrigerant, said compressor having a volumetric efficiency of at least 50% when producing a pressure ratio of at least 5 to 1 in said refrigerant, means for separating oil from said compressed refrigerant and for delivering said separated oil back to said compressor, and means for cooling said compressed refrigerant and for circulating said cooled refrigerant through said heat exchanger and throttling orifice and back to said compressor.

2. The refrigerating system of claim 1 wherein said oil-lubricated compressor comprises a rolling piston compressor.

3. The refrigerating system of claim 1 wherein said one gas comprises 20% to 45% Nitrogen, and at least two of said other gases are selected from Methane, Ethane, Ethylene, Propane, Isopentane and Isobutane.

4. The refrigerating system of claim 2 wherein said gas having a boiling point below 130 degrees K comprises Nitrogen, Argon and/or Methane individually or in some combination, and said other gases are selected from Ethane, Ethylene, Propane, Isopentane and Isobutane.

5. The refrigerating system of claim 4 wherein said Nitrogen or Argon or Methane are included in said mixture in an amount 20% to 45% individually or 20% to 60% in any combination.

6. The refrigerating system of claim 2 wherein said heat exchanger is a Joule-Thomson cryostat.

7. The refrigerating system of claim 2 wherein said rolling piston compressor produces pressures in said refrigerant in the range of 0.05 to 0.5 MPa low pressure and 1.5 to 3.0 MPa high pressure.

8. The refrigerating system of claim 7 wherein said gas mixture comprises 0.36 Nitrogen, 0.2 Methane, 0.12 Ethylene, 0.2 Propane, and 0.12 Isobutane within a variation of the percentages of plus or minus 30%.

9. The refrigerating system of claim 8 wherein said rolling piston compressor produces in the refrigerant a low pressure in the neighborhood of 0.35 MPa and a high pressure in the neighborhood of 2.45 MPa.

10. The refrigerating system of claim 2 wherein said heat exchanger having a throttling orifice comprises a Joule-Thomson cryostat, and all of the compressed and cooled refrigerant is passed through said throttling orifice.

11. The refrigerating system of claim 7 wherein said one gas in said gas mixture comprises Nitrogen and at least two other gases in said mixture are selected from Methane, Ethane, Ethylene, Propane, and Isobutane, and the pressure ratio produced by said rolling piston compressor is in the range of 6–7 to 1, thereby to provide refrigerating temperatures in the range of 90 degrees K to 125 degrees K.

12. The refrigerating system of claim 7 wherein said rolling piston compressor has a volumetric efficiency above 70% at a pressure ratio of 4 to 1.

13. The refrigerating system of claim 2, wherein said gas mixture comprises 0.35 Methane, 0.25 Ethane, 0.25 Propane and 0.15 Isobutane within a variation of the percentages of plus or minus 30%.

14. The refrigerating system of claim 1 wherein said single stage compressor produces a pressure ratio in said refrigerant in the range of 5–18 to 1 and has a volumetric efficiency in the range of 50% to 75%.

15. The refrigerating system of claim 14 wherein said at least one gas having a boiling temperature below 130 degrees K is selected from Nitrogen, Argon and Methane; said at least two other gases having a boiling temperature below 300 degrees K are selected from Nitrogen, Argon, Methane, Ethane, Ethylene, Propane, Isopentane and Isobutane; said cooling means comprises an aftercooler; and said oil separating means is connected to separate oil from said compressed refrigerant before said compressed refrigerant is cooled by said aftercooler.

16. The refrigerating system of claim 14 wherein said at least one gas having a boiling temperature below 130 degrees K is selected from Nitrogen, Argon and Methane; said at least two other gases having a boiling temperature below 300 degrees K are selected from Nitrogen, Argon, Methane, Ethane, Ethylene, and Propane; said cooling means comprises an aftercooler; and said oil separating means is connected to separate oil from said compressed refrigerant after said compressed refrigerant is cooled by said aftercooler.

* * * * *